US006953294B2

(12) United States Patent
Chiu et al.

(10) Patent No.: US 6,953,294 B2
(45) Date of Patent: Oct. 11, 2005

(54) POSITIONING APPARATUS INSTALLED INSIDE A PRINTER

(75) Inventors: Chui-Chien Chiu, Taipei (TW); Kai-Min Chu, Taipei (TW)

(73) Assignee: Hi-Touch Imaging Technologies Co., Ltd., Pan-Chiao (TW)

( * ) Notice: Subject to any disclaimer, the term of this patent is extended or adjusted under 35 U.S.C. 154(b) by 0 days.

(21) Appl. No.: 10/708,244

(22) Filed: Feb. 19, 2004

(65) Prior Publication Data

US 2005/0186004 A1 Aug. 25, 2005

(51) Int. Cl.[7] ..... B41J 23/00
(52) U.S. Cl. ..... 400/359; 400/322; 400/363; 400/364
(58) Field of Search ..... 400/359, 363, 400/364, 355, 322, 323

(56) References Cited

U.S. PATENT DOCUMENTS 4,601,241 A * 7/1986 Fujiwara ..... 101/93.04
4,884,907 A * 12/1989 Yasumi ..... 400/216.1
5,064,304 A * 11/1991 Hosokawa et al. ..... 400/216.1
5,075,609 A * 12/1991 Ito et al. ..... 318/696
5,391,008 A * 2/1995 Hattori ..... 400/605
5,666,880 A * 9/1997 Barrus ..... 101/93.04
5,971,639 A * 10/1999 Park ..... 400/621
6,572,211 B2 * 6/2003 Ootsubo et al. ..... 347/16
6,705,784 B2 * 3/2004 Furuya et al. ..... 400/621
6,715,947 B1 * 4/2004 Cornelius et al. ..... 400/322

* cited by examiner

*Primary Examiner*—Andrew H. Hirshfeld
*Assistant Examiner*—Dave A. Ghatt
(74) *Attorney, Agent, or Firm*—Winston Hsu

(57) ABSTRACT

According to the claimed invention, a positioning apparatus is disclosed. The positioning apparatus comprises a motor and a Scotch yoke for controlling the position of a first printer part. The motor is for providing a rotational motion to the Scotch yoke. In response, part of the Scotch yoke moves in a linear fashion. As a result of the linear motion of the Scotch yoke, the position of the first printer part can be controlled.

11 Claims, 25 Drawing Sheets

Initial Stage

Load Stage

Print Stage

Eject Stage

Initial

Load

Print

Initial Stage

Print Stage

Eject Stage

Initial Stage

Load Stage

Print Stage

Eject Stage

Initial Stage

Load Stage

Print Stage

Eject Stage

| | Pinch | Platen | Reverse RBN | Clutch | Lifter |
|---|---|---|---|---|---|
| Initial | Press/separation | Press/separation | Non-press/contact | Non-press/contact | Non-press/contact |
| Load | Non-press/contact | Press/separation | Non-press/contact | Non-press/contact | Non-press/contact |
| Print | Non-press/contact | Non-press/contact | Press/separation | Press/separation | Press/Incapable |
| Eject | Non-press/contact | Press/separation | Non-press/contact | Non-press/contact | Press/Incapable |

Fig. 23

POSITIONING APPARATUS INSTALLED INSIDE A PRINTER

BACKGROUND OF INVENTION

1. Field of the Invention

The invention relates to a positioning apparatus installed inside a printer and more particularly to a positioning apparatus installed inside a printer for controlling the positioning of parts.

2. Description of the Prior Art

In order for a printer to perform its job, many tasks within the printer must take place. Several of the tasks are similar in the fact that they involve the positioning of a printer part. The position that a printer part is usually dependent on the stage of printing the printer is in. In the case of dye diffusion thermal transfer printers, the position of the printer parts can be divided into being either in contact or non-contact with another printer part and the stages of printing are Initial, Load, Print, and Eject.

Because of the complication in positioning printer parts that have different cycles of contact and non-contact throughout the printing stages, most printers have a controller for each printer part that needs positioning. To illustrate the complication, take the following as an example. The task of pinching the paper involves positioning the printers pinch into the contact position (relative to the printers capstan) during the Load, Print, and Eject stage while positioning the printers pinch into the non-contact position (relative to the printers capstan) in the Initial stage. However, the task of bringing paper to the printers print head involves positioning the printers platen into the contact position (relative to the print head) during the Print stage but positioning the printers platen into the non-contact position (relative to the print head) in the Initial, Load, and Eject stage. As one can see, both tasks in the example involve positioning a part into either a contact or non-contact position but with each task having its own timing of contact and non-contact throughout the printing stages.

The common solution of providing a controller to move each of these printer parts is adequate to address the complication but not without its drawbacks. Employing the common solution, as in the example above, meant that two controllers are needed one for the pinch and the other for the platen. The drawback is that the printer has several parts, meaning that will be a corresponding number of controllers. Increased number of controllers translates into increased production cost, which may be small in the manufacturing of a single printer but is increased many times over during the mass production of the printer.

SUMMARY OF INVENTION

It is therefore a primary objective of the claimed invention to provide a positioning apparatus employing a Scotch yoke for controlling the position of a first printer part, wherein the position of the first printer part is controlled by the rotational motion of the motor via the linear motion of the Scotch yoke.

According to the claimed invention, a positioning apparatus is disclosed. The positioning apparatus comprises a motor and a Scotch yoke for controlling the position of a first printer part. The motor is for providing a rotational motion to the Scotch yoke. In response, part of the Scotch yoke moves in a linear fashion. As a result of the linear motion of the Scotch yoke, the position of the first printer part can be controlled.

In one of the many embodiments of the present invention, the Scotch yoke itself comprises a rotating part for providing rotational motion, a sliding part coupled to the rotating part for converting the rotational motion into a linear motion, and a protrusion extending from the sliding part for placing the Scotch yoke in contact with the first printer part, wherein the rotational motion of the rotating part causes the sliding part to move in a back-and-forth linear motion which in turn causes the protrusion to be in-and-out of contact with the first printer part.

The first printer part can be any number of things including but not limited to a pinch, a platen, a reverse ribbon, a clutch, and an arm swing lifter.

Please note that the claimed invention is capable of having multiple first printer parts that the Scotch yoke can come in contact with. The number of protrusions on the sliding part of the Scotch yoke is dependent upon how many first printer parts the designer would like to control.

These and other objectives of the claimed invention will no doubt become obvious to those of ordinary skill in the art after reading the following detailed description of the preferred embodiment that is illustrated in the various figures and drawings.

BRIEF DESCRIPTION OF DRAWINGS

FIG. 23 is a chart that shows the action of the positioning apparatus and how it effects the position of a first printer part.

DETAILED DESCRIPTION

Figure 1:
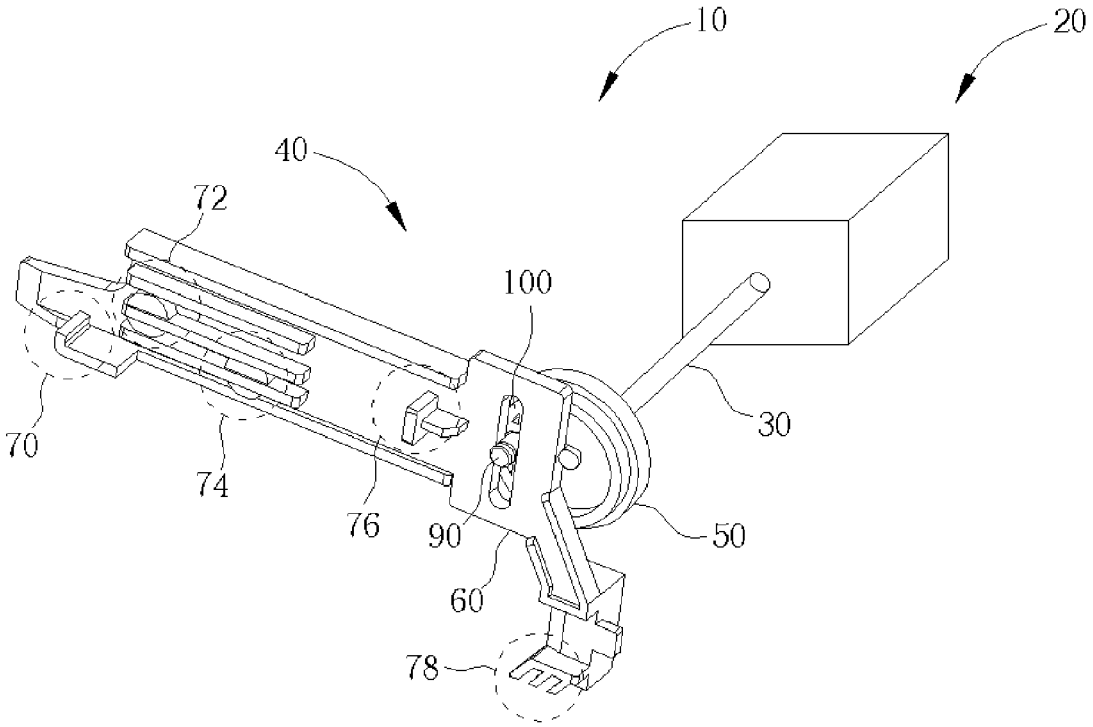
FIG. 1 is a perspective view of a positioning apparatus from one side according to the present invention.

Please refer to FIG. 1. FIG. 1 is a perspective view of the positioning apparatus 10 from one side according to the present invention. In this preferred embodiment, the positioning apparatus 10 comprises a motor 20 for providing a rotational motion, a Scotch yoke 40 for converting the rotational motion into a linear motion, and a rod 30 for transferring the rotational motion of the motor 20 to the Scotch yoke 40, wherein the position of a first printer part (not shown) is controlled by the rotational motion of the motor 20 via the linear motion of the Scotch yoke 40. Please note that the use of the rod 30 for transferring the rotational motion is only an example. The motor 20 could employ other means to have its rotational motion transferred or could even be directly coupled to the Scotch yoke 40 and thereby bypassing the use of an object for transferring rotational motion between the motor 20 and the Scotch yoke 40.

The Scotch yoke 40 comprises a rotating part 50 for converting the rotation motion supplied by the motor, a sliding part 60 coupled to the rotating part 50 for converting the rotational motion into a linear motion, and a protrusion 70, 72, 74, 76, or 78 extending from the sliding part 60 for placing the Scotch yoke in contact with a first printer part (not shown). In this preferred embodiment, a disc serves as the rotating part 50 and an arm serves as the sliding part 60. Furthermore, the disc 50 and arm 60 are coupled together via a connecting protrusion 90 extending from the disc 50 into a vertical slit 100 of the arm 60. Please note that, although the FIG. 1 depicts the Scotch yoke 40 as having 5 protrusions, this number of protrusions should not be taken as a limitation on the present invention. The Scotch yoke could have as few as 1 protrusion or more than 5 protrusions and still remain within the spirit of the present invention. The number of protrusions is dependent on a designers needs and subject to change. Thus, the 5 depicted protrusions should be taken only as an example.

Figure 2:
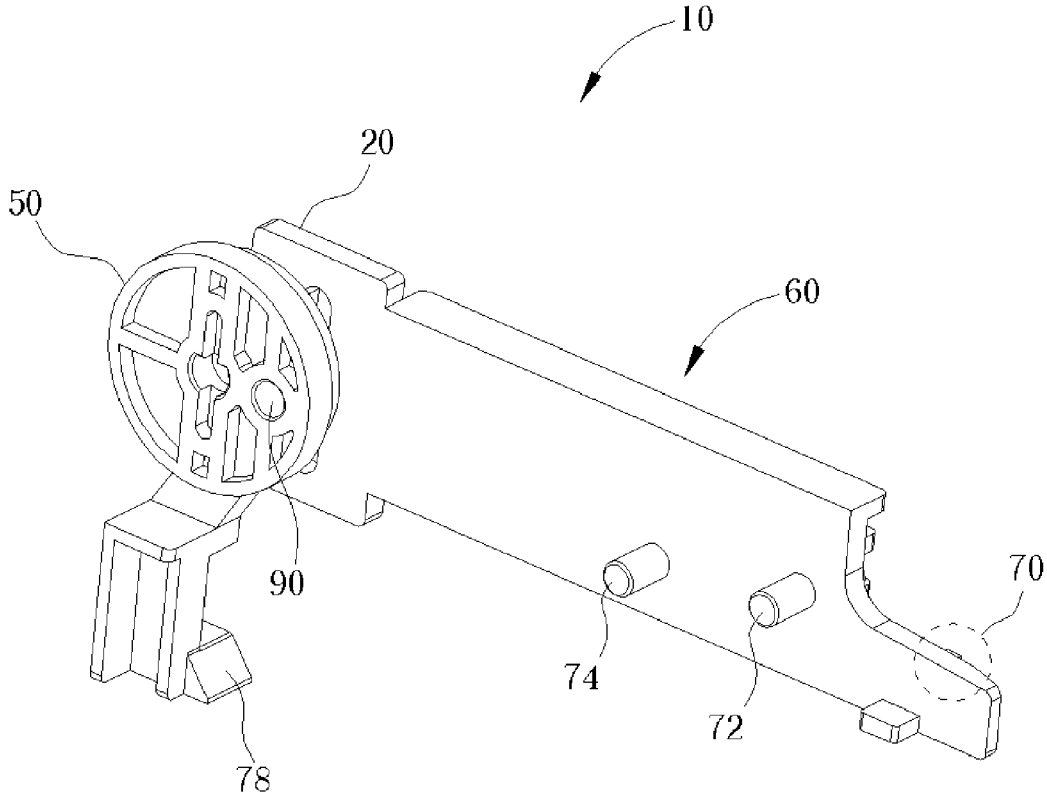
FIG. 2 is a perspective view of a positioning apparatus in FIG. 1 rotated around to the other side according to the present invention.

For another view of the positioning apparatus 10, please refer to FIG. 2. FIG. 2 is a perspective view of a positioning apparatus in FIG. 1 rotated around to the other side according to the present invention (without the motor 20 and rod 30). From this angle, one can see that protrusions 72, 74 actually extend from the side of the arm 60 opposite to the protrusions 70, 76, 78.

According to the preferred embodiment of the present invention, the positioning apparatus 10 works as follows. The motor 20 supplies a rotational motion 30, which is transferred via the rod 30 to the Scotch yoke 40. The disc 50 of the Scotch yoke 40 receives the rotational motion and rotates in response, which in turn cause the arm 60 of the Scotch yoke 40 to slide back-and-forth linearly. As the arm 60 slides back-and-forth, the protrusion 70,72, 74, 76, or 78 extending from the arm 60 will be placed in-and-out of contact with a first printer part. As a result, the Scotch yoke 40 is able to execute either a pressing or non-pressing action upon the first printer part.

To further illustrate, please refer to FIG. 3–FIG. 22. Please note that actions of the positioning apparatus 10 are divided according to the stages of printing. The stages of printing used in FIG. 3–FIG. 22 are that found in a dye diffusion thermal transfer printer, wherein the stages of printing are Initial, Load, Print, and Eject. The use of stages of printing in a dye diffusion thermal transfer printer is meant to serve only as an example. Other printers with different stages of printing may be substituted without changing the spirit of the present invention. Please also note in the examples given in FIG. 3–FIG. 22, the motor 20 rotates the rod 30 in a clockwise direction, and thus, the disc 50 of the Scotch yoke 40 also rotates in a clockwise direction. In this embodiment, the arm 60 of the Scotch yoke 40 is withdrawn completely to the right in the initial stage. As the printer enters the load stage, the arm 60 moves forward to the left. The arm 60 reaches the leftmost location in the print stage and begins to move back to the right in the eject stage. In such a way, the arm 60 is able to achieve a back-and-forth linear motion. Since the protrusion 70, 72, 74, 76, or 78 are located on the arm 60, it too moves back-and-forth.

Figure 3:
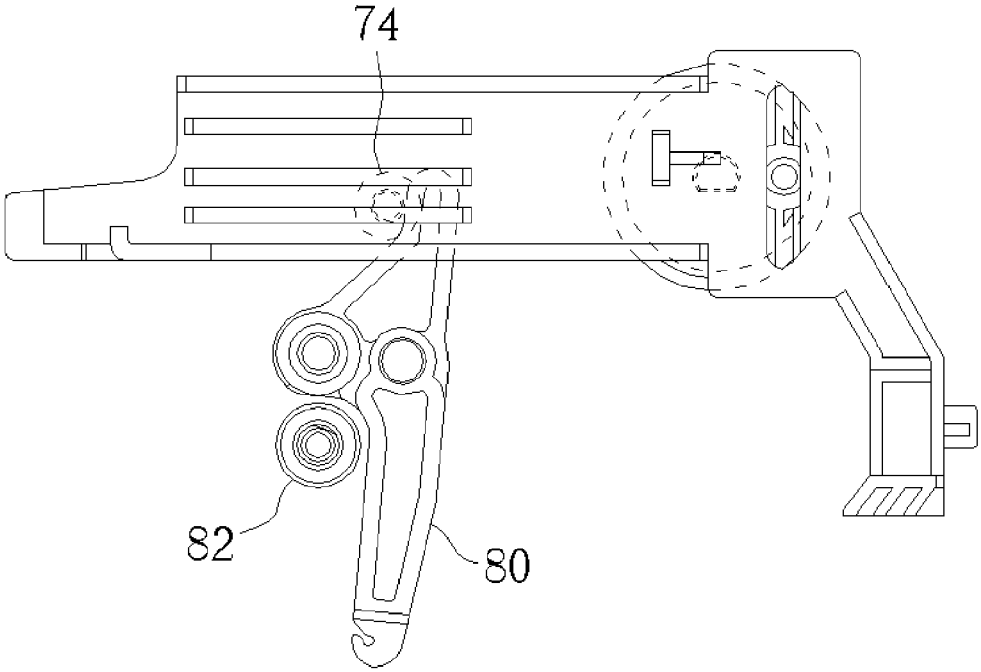
FIG. 3 is a perspective view of the action of a positioning apparatus in the initial stage when the first printer part is a pinch.
Figure 4:
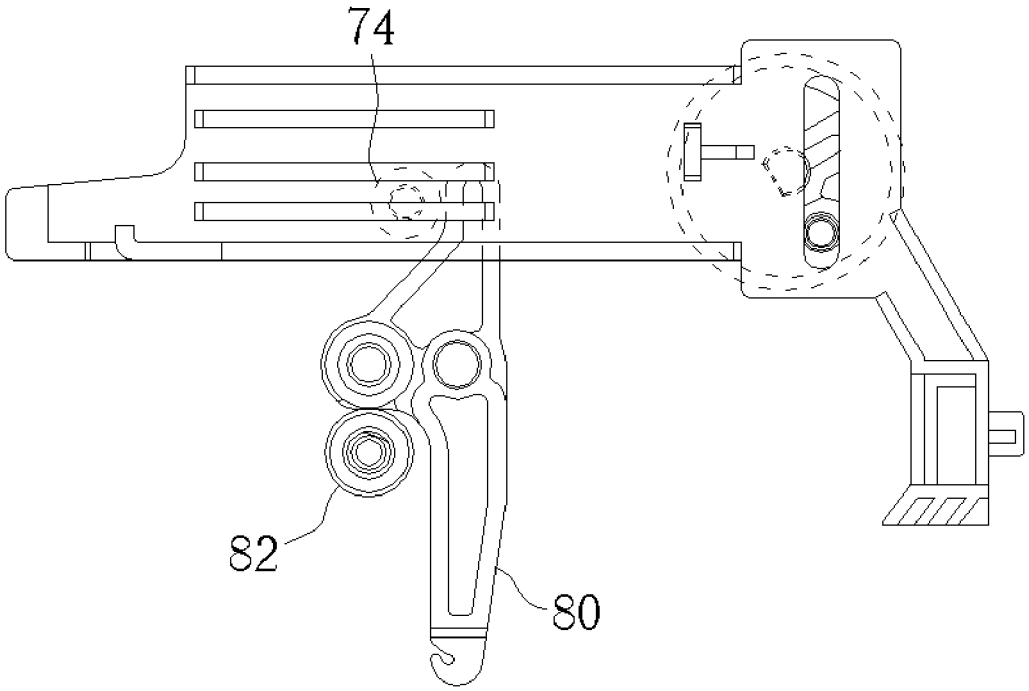
FIG. 4 is a perspective view of the action of a positioning apparatus in the load stage when the first printer part is a pinch.
Figure 5:
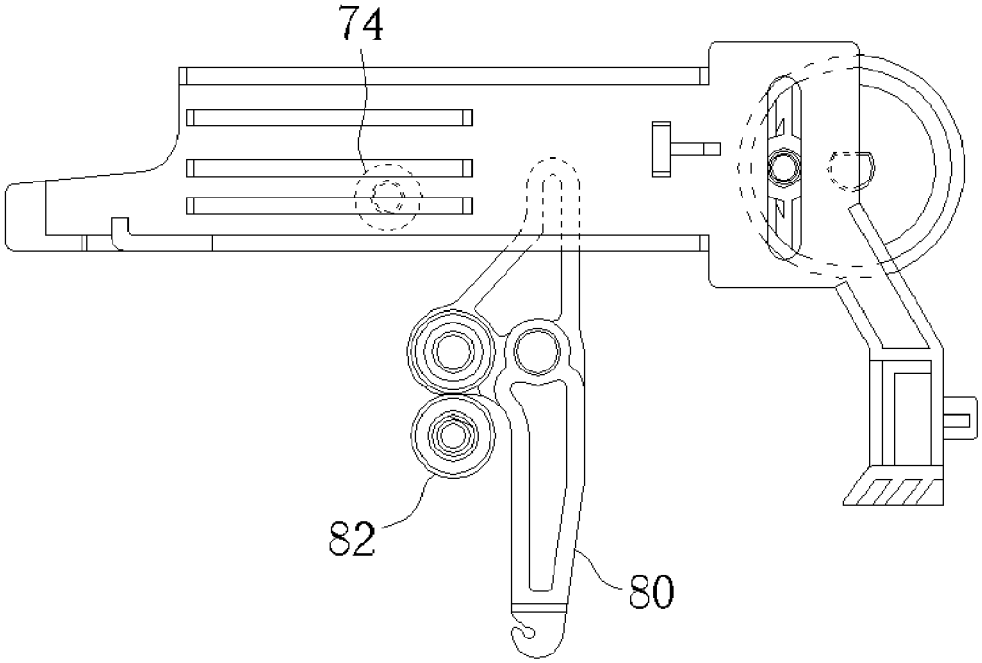
FIG. 5 is a perspective view of the action of a positioning apparatus in the print stage when the first printer part is a pinch.
Figure 6:
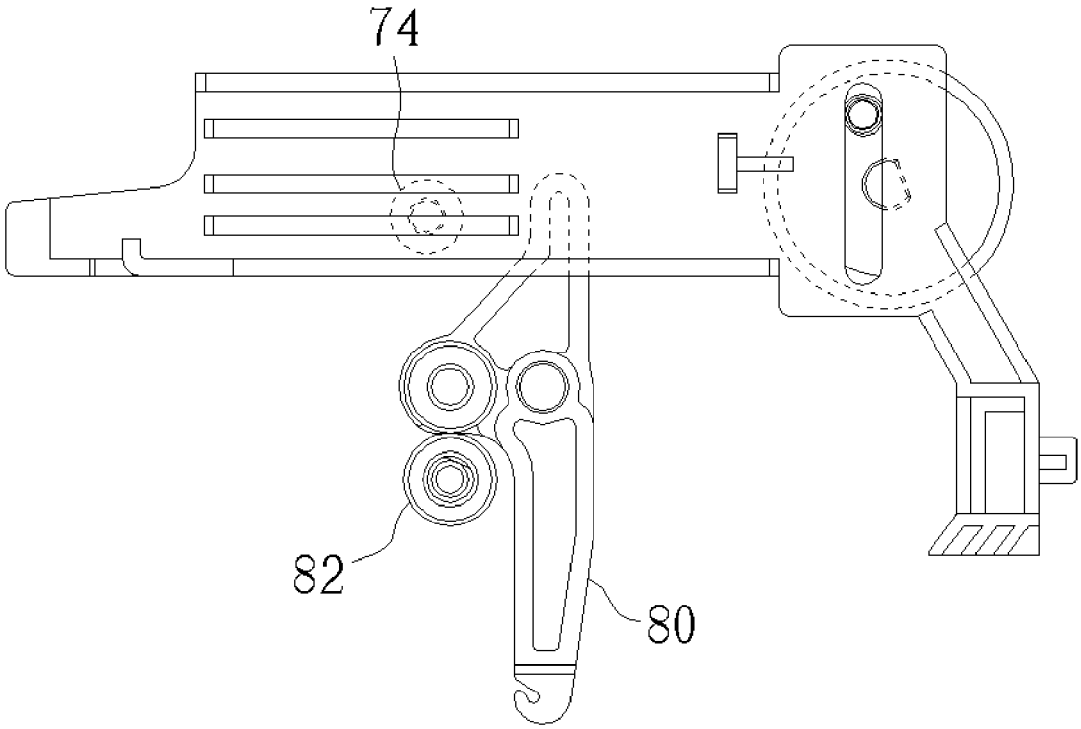
FIG. 6 is a perspective view of the action of a positioning apparatus in the eject stage when the first printer part is a pinch.

Please refer to FIG. 3–FIG. 6. When taken together, FIG. 3–FIG. 6 show a step-by-step view of the actions of a positioning apparatus 10 when the first printer part is a pinch 80. As shown in FIG. 3, during the initial stage, the protrusion 74 is pressed against the pinch 80. By pressing against the pinch 80, the protrusion 74 is able to place the pinch 80 into a separated position with respect to the capstan roller 82. As shown in FIG. 4–FIG. 6, which respectively corresponding to the load, print, and eject stages, the figures shows that the protrusion 74 no longer presses against the pinch 80. Since there is no pressing action in these stages, the pinch 80 is able to pivot forward and thus enter a contact position with respect to the capstan roller 82.

Figure 7:
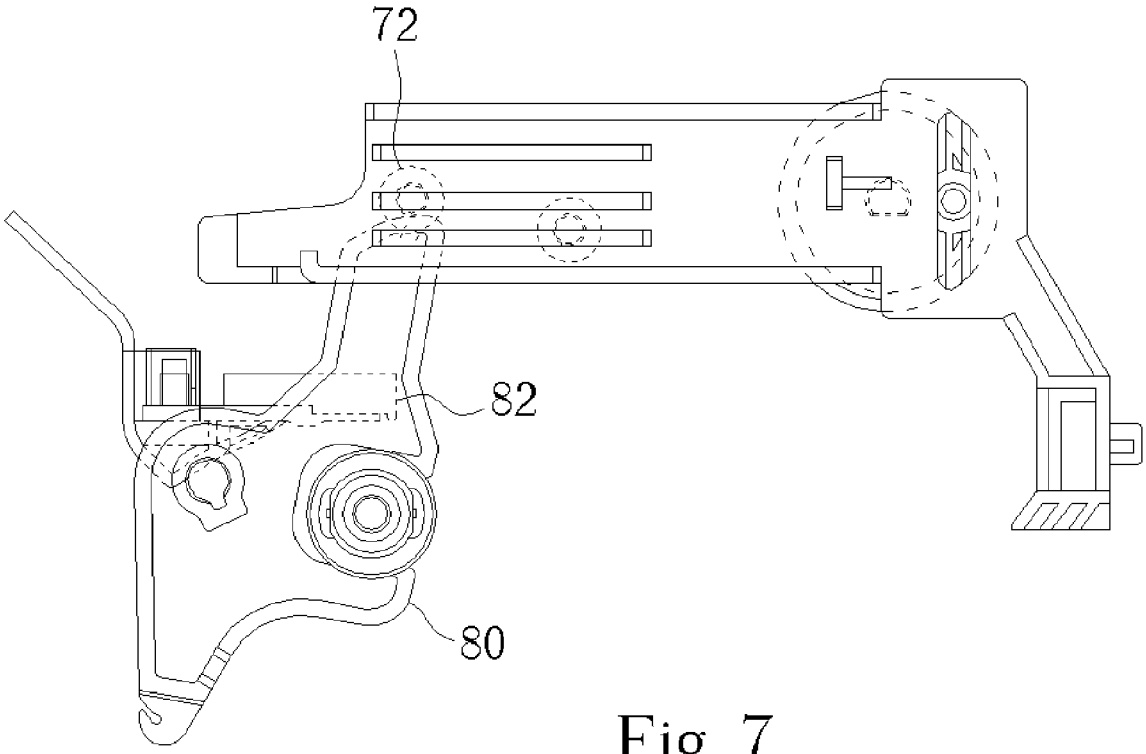
FIG. 7 is a perspective view of the action of a positioning apparatus in the initial stage when the first printer part is a platen.
Figure 8:
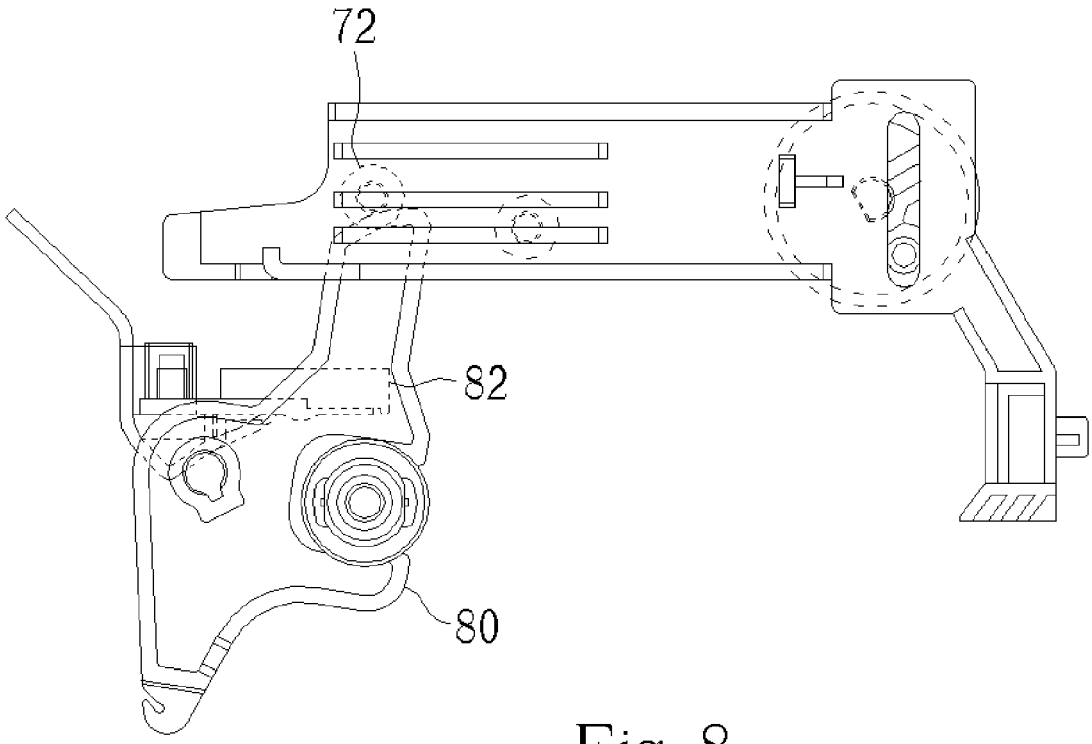
FIG. 8 is a perspective view of the action of a positioning apparatus in the load stage when the first printer part is a platen.
Figure 9:
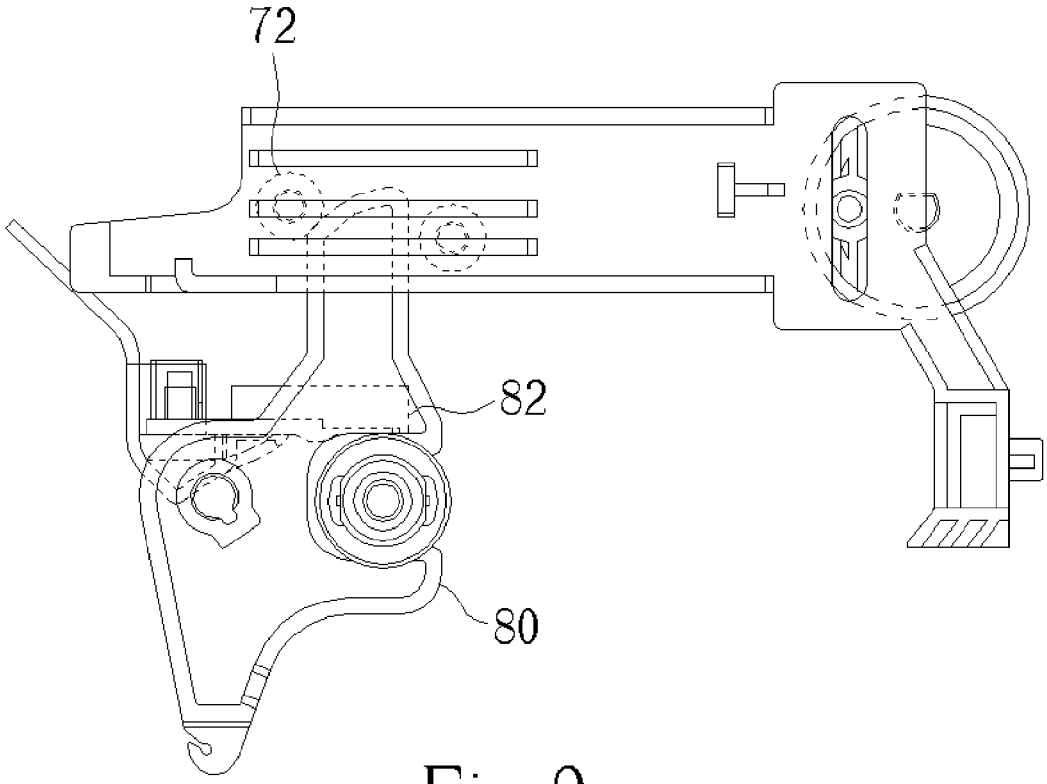
FIG. 9 is a perspective view of the action of a positioning apparatus in the print stage when the first printer part is a platen.
Figure 10:
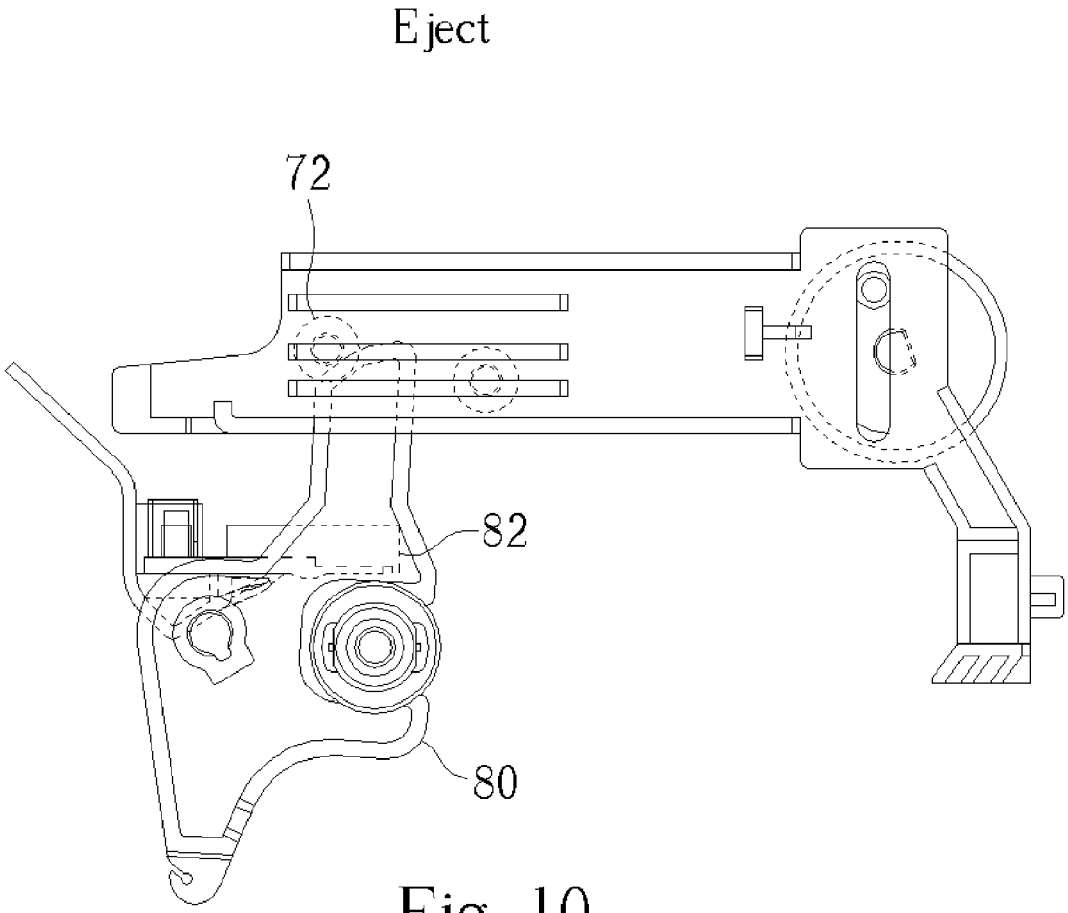
FIG. 10 is a perspective view of the action of a positioning apparatus in the eject stage when the first printer part is a platen.

Please refer to FIG. 7–FIG. 10. When taken together, FIG. 7–FIG. 10 show a step-by-step view of the actions of a positioning apparatus 10 when the first printer part is a platen 80, specifically the roller portion of the platen. As shown in FIG. 7, during the initial stage, the protrusion 72 presses down on the platen 80 and as a result, positions the roller of the platen 80 into a separated position with respect to the thermal print head 82. The protrusion 72 continues to press down on the platen 80 during the load stage, which is shown in FIG. 8, before moving out of contact with the platen 80 in the print stage, which is shown in FIG. 9. Once, the protrusion 72 moves out of contact and hence, no longer presses down on the platen 80, the platen 80 is free to pivot and move the roller of the platen 80 into a contact position with respect to the thermal print head 82. Upon entering the eject stage, which is shown in FIG. 10, the protrusion 72 makes contact with the platen 80, where it is then able to execute a pressing action on the platen 80. In response, the platen 80 pivots away from the thermal print head 82 and thus, returned to a separated position with respect to the thermal print head 82.

Figure 11:
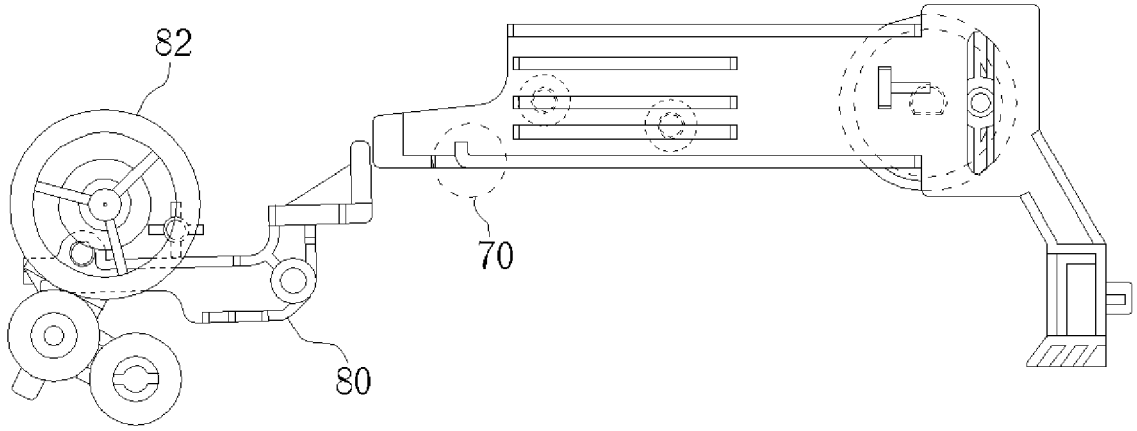
FIG. 11 is a perspective view of the actions of a positioning apparatus in the initial stage when the first printer part is a reverse ribbon.
Figure 12:
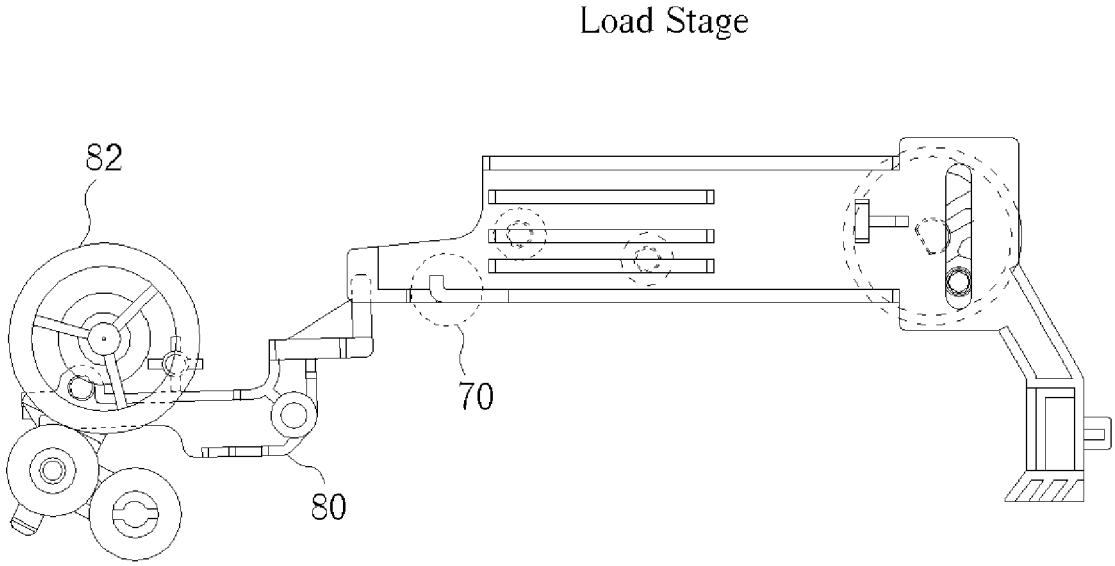
FIG. 12 is a perspective view of the actions of a positioning apparatus in the load stage when the first printer part is a reverse ribbon.
Figure 13:
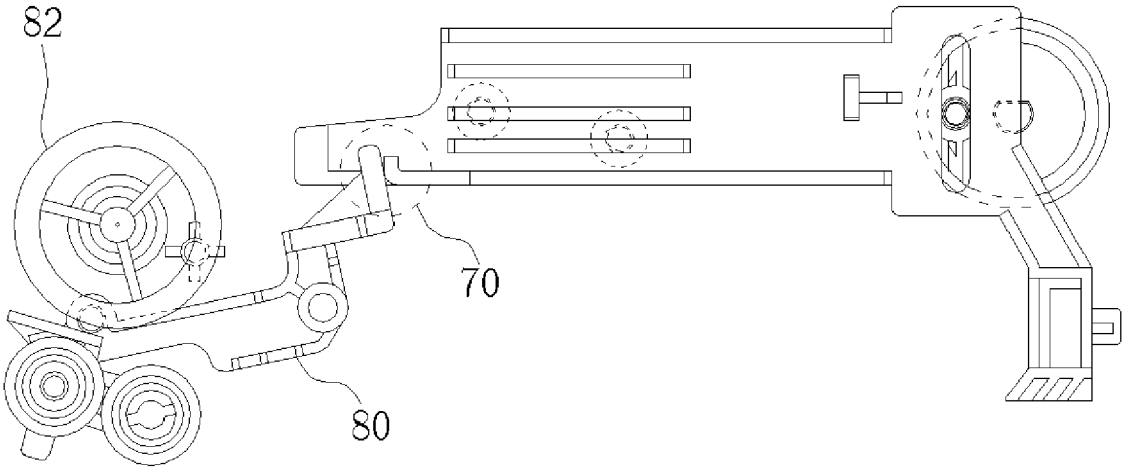
FIG. 13 is a perspective view of the actions of a positioning apparatus in the print stage when the first printer part is a reverse ribbon.
Figure 14:
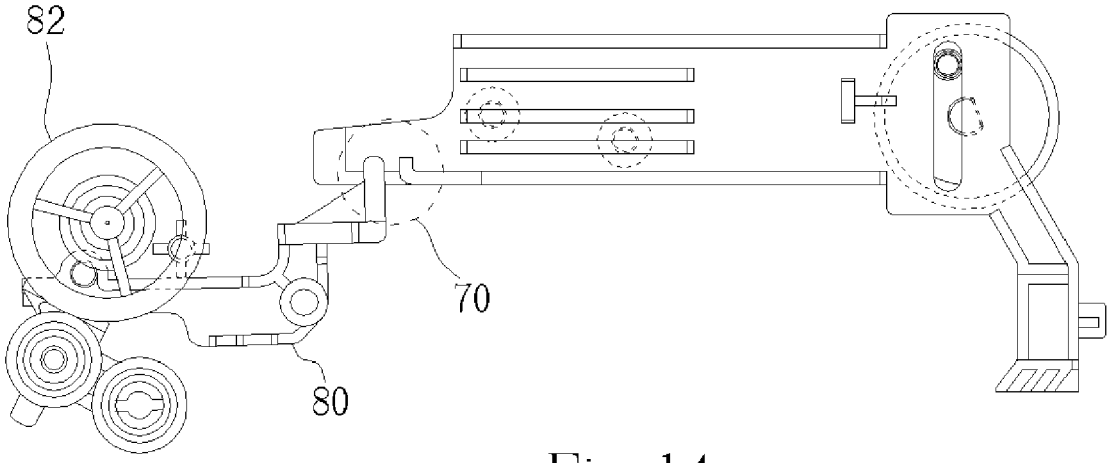
FIG. 14 is a perspective view of the actions of a positioning apparatus in the eject stage when the first printer part is a reverse ribbon.

Please refer to FIG. 11–FIG. 14. When taken together, FIG. 11–FIG. 14 show a step-by-step view of the actions of a positioning apparatus 10 when the first printer part is a reverse ribbon 80. As shown in FIG. 11 and FIG. 12 respectively, during the initial and load stage, the protrusion 70 is not in contact with the reverse ribbon 80. With no pressing action, the reverse ribbon is positioned in a contact position with respect to the spool 82. However, upon entering the print stage as shown in FIG. 13, the protrusion 70 makes contact with the reverse ribbon 80. As a result, the protrusion 70 is able to press against the reverse ribbon 80, which causes the reverse ribbon 80 to buckle. By buckling, the reverse ribbon 80 enters a separated position with respect to the spool 82. Afterwards, the positioning apparatus 10 enters the eject stage as shown in FIG. 14, wherein the protrusion 70 no longer presses against the reverse ribbon 80. This in turn allows the reverse ribbon 80 to unbuckle, causing the reverse ribbon 80 to once again enter a contact position with respect to the spool 82.

Figure 15:
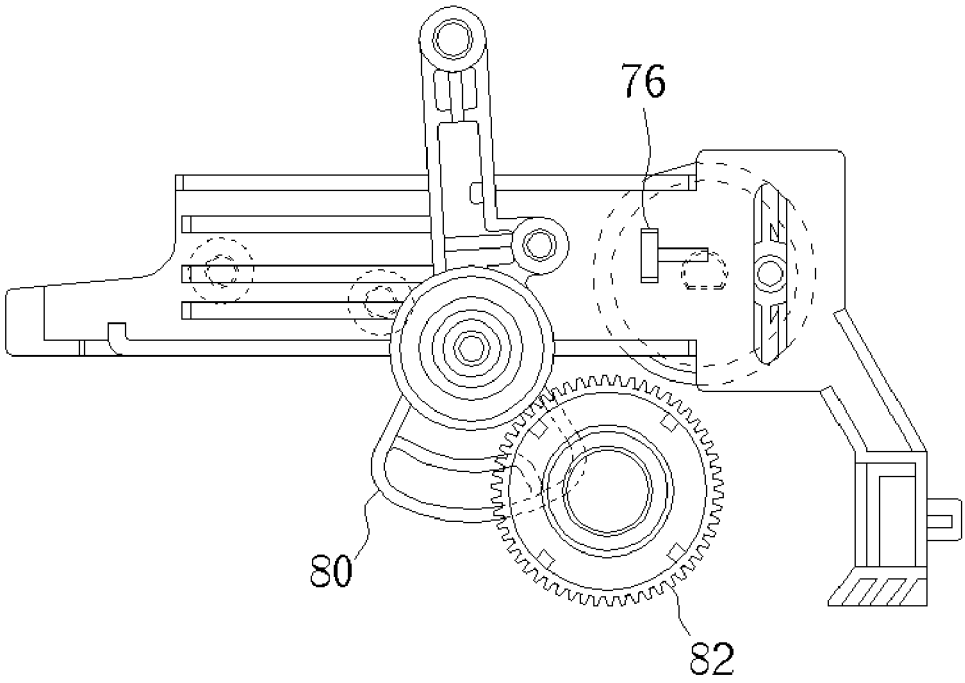
FIG. 15 is a perspective view of the actions of a positioning apparatus in the initial stage when the first printer part is a clutch.
Figure 16:
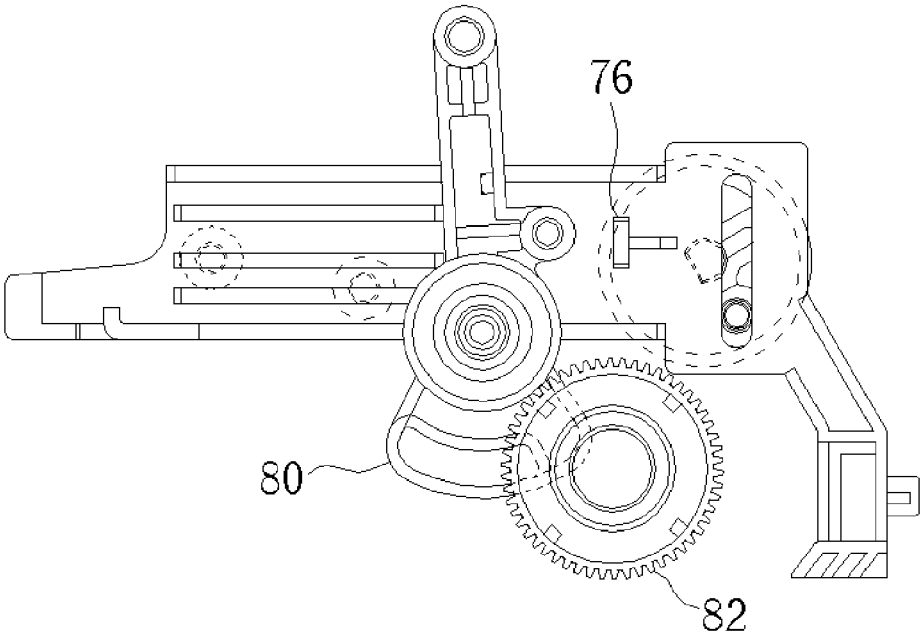
FIG. 16 is a perspective view of the actions of a positioning apparatus in the load stage when the first printer part is a clutch.
Figure 17:
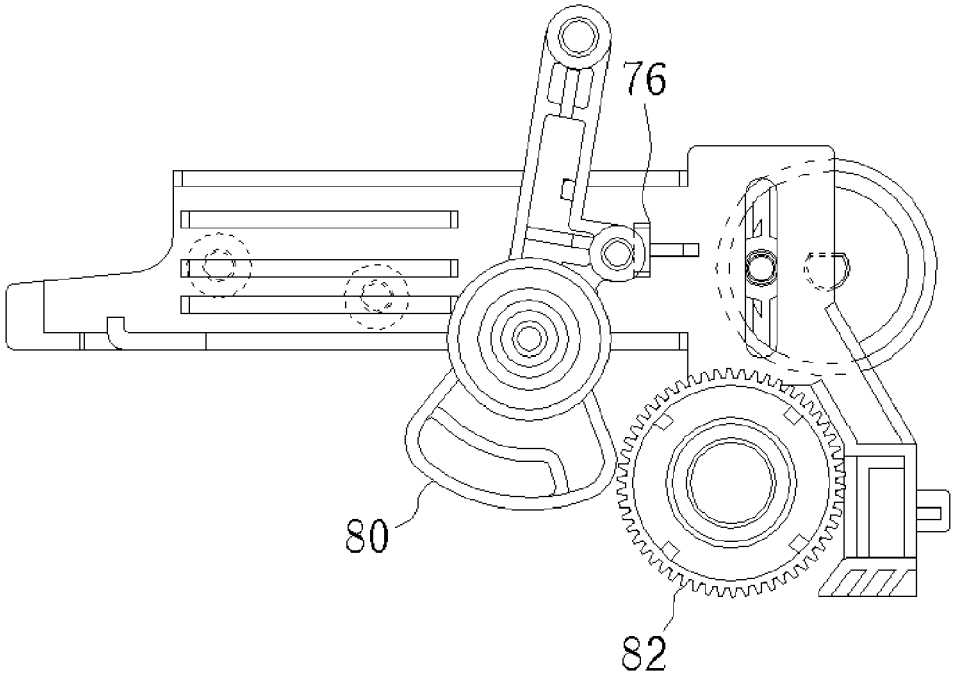
FIG. 17 is a perspective view of the actions of a positioning apparatus in the print stage when the first printer part is a clutch.
Figure 18:
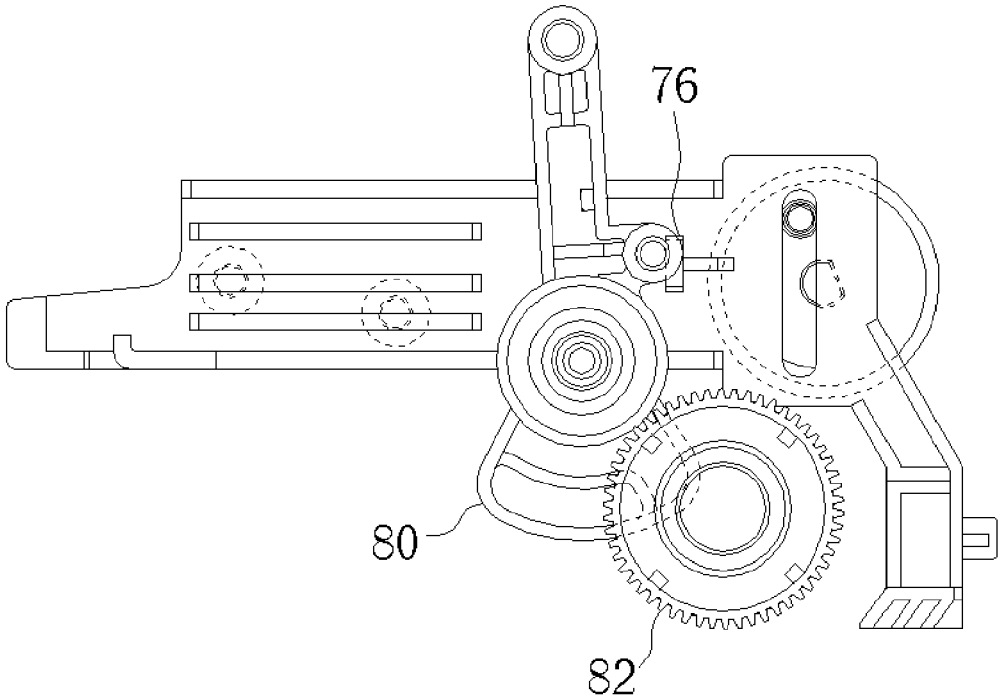
FIG. 18 is a perspective view of the actions of a positioning apparatus in the eject stage when the first printer part is a clutch.

Please refer to FIG. 15–FIG. 18. When taken together, FIGS. 15–18 show a step-by-step view of the actions of a positioning apparatus 10 when the first printer part is a clutch 80. As shown in FIG. 15 and FIG. 16 respectively, during the initial and load stage, the protrusion 76 is not in contact with the clutch 80. With no pressing action, the clutch 80 is positioned in a contact position with respect to the gear 82. However, upon entering the print stage as shown in FIG. 17, the protrusion 76 makes contact with the clutch 80. As a result, the protrusion 76 is able to press against the clutch 80, which causes the clutch 80 to pivot away from the gear 82. In such a way, the positioning apparatus 10 is able to position the clutch 80 into a separated position with respect to the gear 82. Afterwards, the positioning apparatus 10 enters the eject stage as shown in FIG. 18, wherein the protrusion 76 no longer presses against the clutch 80. This in turn allows the clutch 80 to pivot toward the gear 82, causing the clutch 80 to once again enter a contact position with respect to the gear 82.

Figure 19:
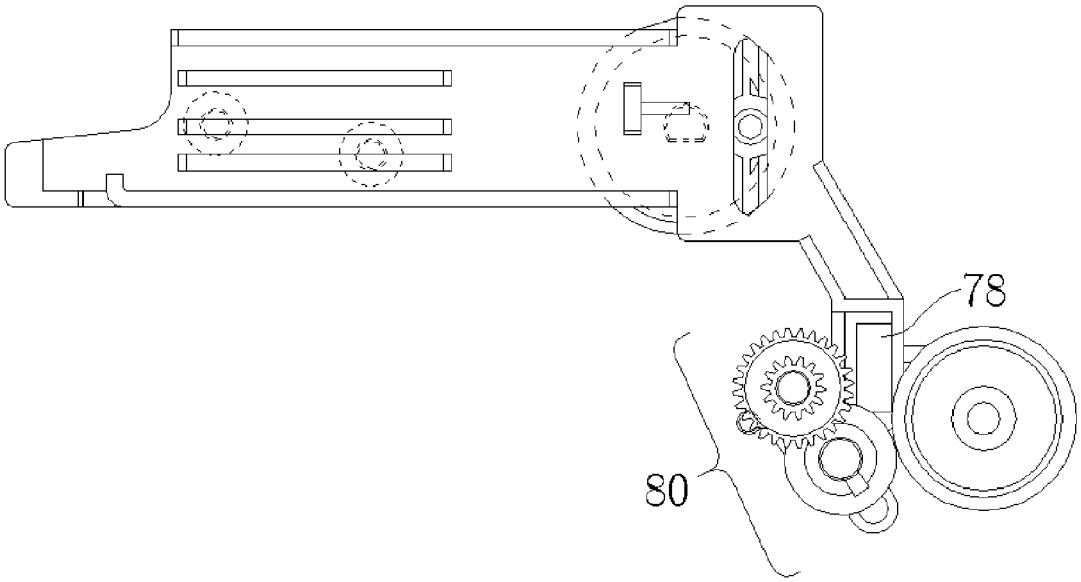
FIG. 19 is a perspective view of the actions of a positioning apparatus in the initial stage when the first printer part is a lifter.
Figure 20:
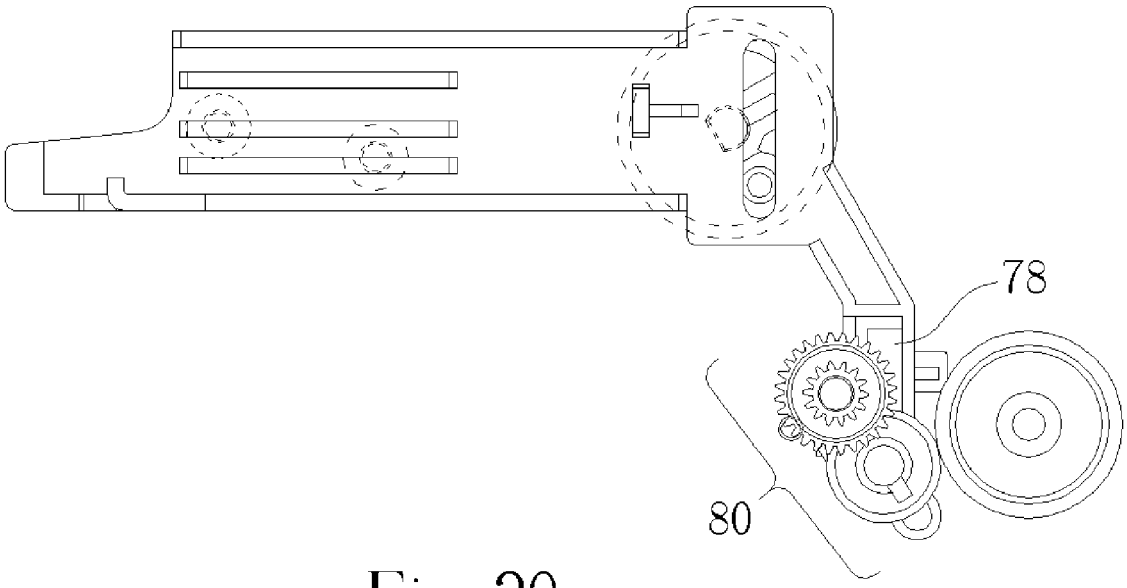
FIG. 20 is a perspective view of the actions of a positioning apparatus in the load stage when the first printer part is a lifter.
Figure 21:
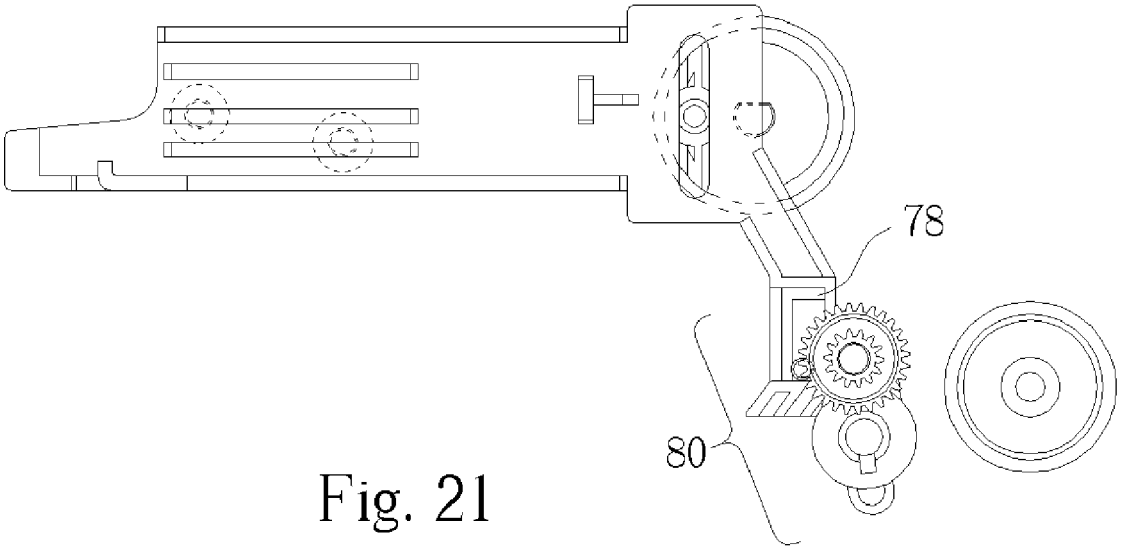
FIG. 21 is a perspective view of the actions of a positioning apparatus in the print stage when the first printer part is a lifter.
Figure 22:
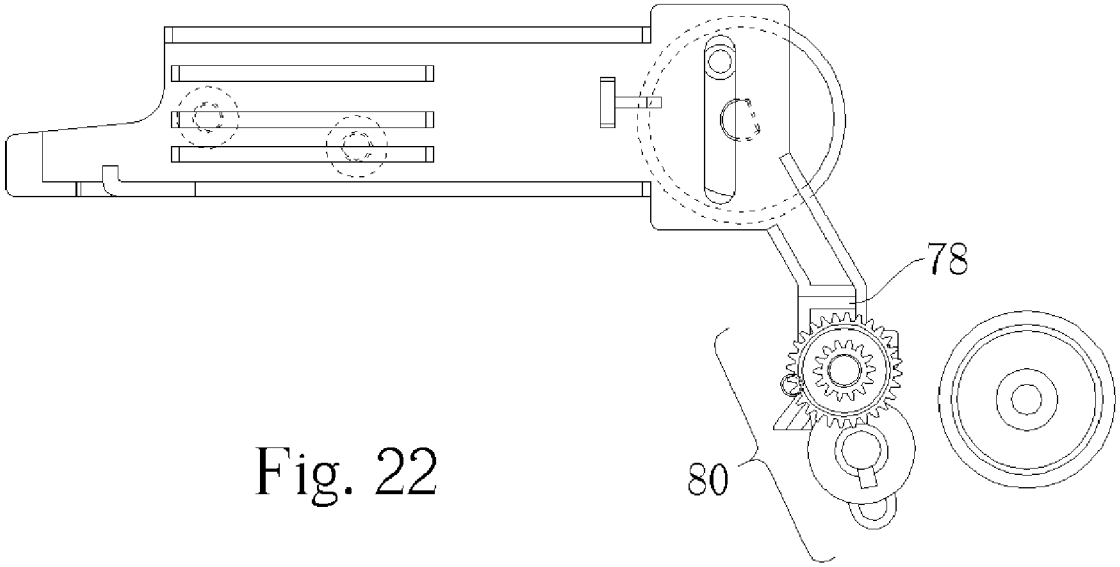
FIG. 22 is a perspective view of the actions of a positioning apparatus in the eject stage when the first printer part is a lifter.

Please refer to FIG. 19–FIG. 22. When taken together, FIG. 19–FIG. 22 show a step-by-step view of the actions of a positioning apparatus 10 when the first printer part is a lifter 80. As shown in FIG. 19 and FIG. 20 respectively, during the initial and load stages, the protrusion 78, even though in contact with the lifter 80, is not executing a pressing action-in other words, the protrusion 78 is not pressing up against the lifter 80. As a result, the lifter 80 is in a position where it is capable of lifting paper. However, in the print and eject stages as shown in FIG. 21 and FIG. 22 respectively, the protrusion 78 presses up against the lifter 80. As a result, the lifter 80 pivots forward to the right and enters a position where it is incapable of lifting paper.

To summarize the information in FIG. 3–FIG. 22, please refer to the chart in FIG. 23. The chart in FIG. 23 shows the action of the positioning apparatus 10 and how it effects the position of a first printer part. Looking at the pair of words in the entry, the first word indicates the action of the positioning apparatus 10, and the second word indicates how the position of the first printer part is affected by the action.

Figure 24:
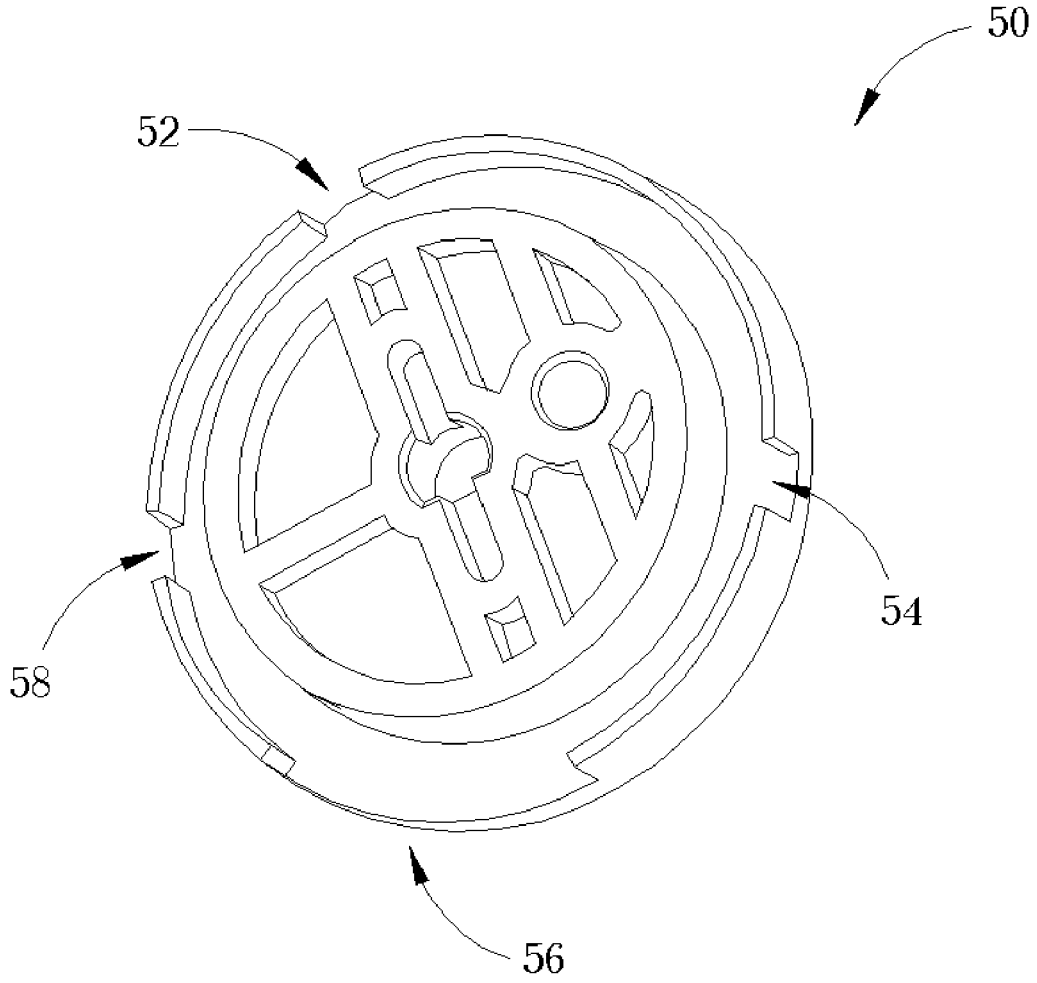
FIG. 24 is a perspective view of only the disc.

Please refer to FIG. 24. FIG. 24 is a perspective view of only the disc 50. To indicate how far the disc 50 of the Scotch yoke 40 needs to rotate, the preferred embodiment of the present invention employs gaps 52, 54, 56, 58 located on the disc 50. The gaps can be spaced at intervals, which correspond to the stages of printing. The length and number of gaps are left to the designer to decide. A sensor is then installed in the printer to sense the gaps of the disc 50. In this way, the printer can tell which stages of printing it is in and how far to rotate the disc 50 of the Scotch yoke 40.

Please note that even though FIG. 3–FIG. 22 only shows one protrusion and one printer part, the protrusions from all the figures can be placed onto one arm 60 of a positioning apparatus 10. A positioning apparatus 10 having all the protrusions shown in FIG. 1–FIG. 2 can therefore move all the printer parts simultaneously shown in the figures. As stated before the number of protrusions is left to the designer. In other words, the number of protrusions extending from the arm 60 of the positioning apparatus 10 is dependent on how many printer parts the designer would like to control. Also, the use of protrusions should be taken as only one method of controlling the position of a printer part using a Scotch yoke in a positioning apparatus.

Figure 25:
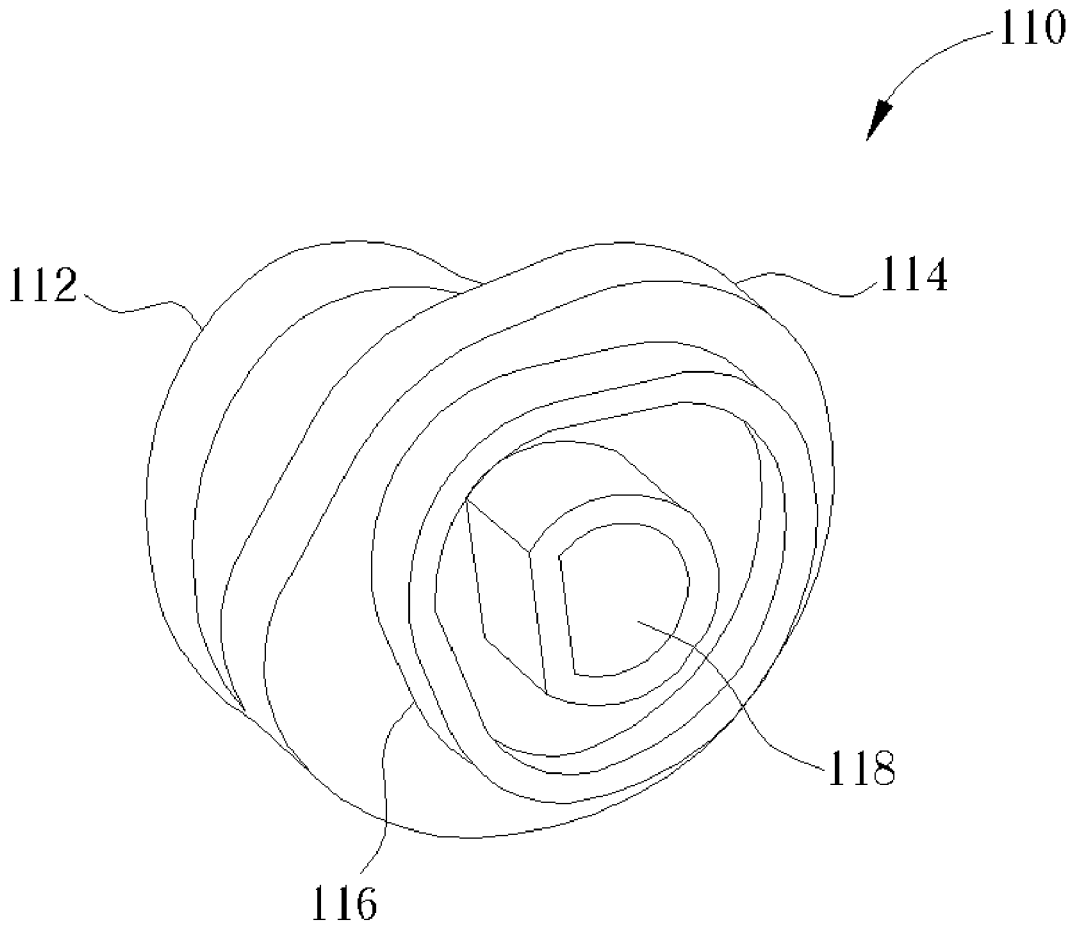
FIG. 25 is a perspective view of a plurality of non-uniform contours disc, which can be added to the present invention to control a second printer part.

Please refer to FIG. 25. FIG. 25 is a perspective view of a plurality of non-uniform contours disc 110, which can be added to the present invention to control a second printer part. In this figure, the plurality of non-uniform contours disc 110 possesses three contours 112, 114, 116. In addition, a plurality of non-uniform contours disc 110 may be placed on the rod 30 used to couple the motor 20 with the Scotch yoke 40. That is to say that the before the rod 30 is inserted between the motor 20 and the Scotch yoke 40, the rod 30 can be placed through the center 118 of the plurality of non-uniform contours disc 100. As the rod 30 rotates so too does the plurality of non-uniform contours disc 100, which in turns controls the positions of a plurality of second printer parts, the number of second printer parts depending upon the number of contours, which in turn is left up to the designer.

To summarize, the present invention is a positioning apparatus installed within a printer comprising a motor and a Scotch Yoke. Using the motor and the Scotch yoke, the positioning apparatus is able to control the position of a first printer part. Also, the positioning apparatus according to the present invention is capable of moving a plurality of printer parts. The number of printer parts is left to the designer. These are only some of the benefits and should not be taken as the limitation of the scope of the invention.

Those skilled in the art will readily observe that numerous modifications and alterations of the device may be made while retaining the teachings of the invention. Accordingly, that above disclosure should be construed as limited only by the metes and bounds of the appended claims.

We claim:

1. A positioning apparatus installed inside a printer for controlling a position of a first printer part, the positioning apparatus comprising:

a motor for providing a rotational motion, a detector; and a Scotch yoke coupled to the motor for converting the rotational motion into a linear motion, the Scotch yoke comprising:

a rotating part for accepting the rotational motion from the motor, the rotating part possessing a gap to indicate the position of the rotating part wherein the position of the rotating part is determined by using the detector to sense the gap located on the rotating part;

wherein the position of the first printer part is controlled by the rotational motion of the motor via the linear motion of the Scotch yoke.

2. The positioning apparatus in claim 1 wherein the Scotch yoke further comprises:

a sliding part coupled to the rotating part for converting the rotational motion into a linear motion; and a protrusion extending from the sliding part for placing the Scotch yoke in contact with the first printer part;

wherein the rotational motion of the rotating part causes the sliding part to move in a back-and-forth linear motion which in turn causes the protrusion to be in-and-out of contact with the first printer part.

3. The positioning apparatus in claim 2 wherein the sliding part is an arm.

4. The positioning apparatus in claim 2 wherein the rotating part possesses a connecting protrusion and the sliding part possesses a vertical slit wherein the sliding part is coupled to the rotating part via the connecting protrusion extending from the rotating part into the vertical slit of the sliding part.

5. The positioning apparatus in claim 1 wherein the rotating part is a disc.

6. The positioning apparatus in claim 1 wherein the rotational motion of the motor is transferred to the rotating part of the Scotch yoke via a rod.

7. The positioning apparatus in claim 1 wherein the actions of the positioning apparatus can be divided into a first action and a second action.

8. The positioning apparatus in claim 7 wherein the first action is a pressing action and the second action is a non-pressing action.

9. The positioning apparatus in claim 1 wherein the first printer part can be a pinch, a platen, a reverse ribbon, a clutch, or a lifter.

10. The positioning apparatus in claim 1 further comprising a plurality of non-uniform contours disc coupled to the motor, the plurality of.

11. A positioning apparatus installed inside a printer for controlling a position of a first printer part, the positioning apparatus comprising:

a motor for providing a rotational motion;

a Scotch yoke coupled to the motor for converting the rotational motion into a linear motion; and a plurality of non-uniform contours disc coupled to the motor, the plurality of non-uniform counters disc having a non-uniform contour for controlling the position of a second printer part;

wherein the position of the first printer part is controlled by the rotational motion of the motor via the linear motion of the Scotch yoke.

* * * * *